United States Patent [19]

Campbell

[11] Patent Number: 4,601,066

[45] Date of Patent: Jul. 22, 1986

[54] FASHION/EXERCISE GARMENT

[76] Inventor: Walter A. Campbell, 744 NE. 113th St., Miami, Fla. 33161

[21] Appl. No.: 715,227

[22] Filed: Mar. 22, 1985

[51] Int. Cl.[4] ..... A41D 1/08; A41D 1/04; A41D 13/00

[52] U.S. Cl. ..... 2/70; 2/90; 2/123; 2/79; 2/227; 2/270

[58] Field of Search ..... 2/79, 227, 232, 93, 2/98, 90, 270, DIG. 6, 115, 123, 125, 70

[56] References Cited

U.S. PATENT DOCUMENTS

| | | | |
|---|---|---|---|
| 1,012,648 | 12/1911 | Karp | 2/270 |
| 1,609,286 | 12/1926 | Bernstein | 2/270 |
| 1,626,136 | 4/1927 | Hart | 2/270 X |
| 2,115,974 | 5/1938 | Harris et al. | 2/270 X |
| 2,717,437 | 9/1955 | De Mestral | 2/DIG. 6 |
| 2,730,723 | 1/1956 | Jonsson | 2/270 |
| 3,083,373 | 4/1963 | Rizzotto | 2/270 |

*Primary Examiner*—H. Hampton Hunter
*Attorney, Agent, or Firm*—Paul J. Sutton

[57] ABSTRACT

The invention features a fashion/exercise garment for use by dancers, gymnasts and acrobats. The garment has built-in warming wraps disposed at extremity portions of the garment, such as the neck, wrists and ankles. The wraps comprise elongated bindings extending from, and affixedly winding about the garment.

15 Claims, 12 Drawing Figures

FIG. 10
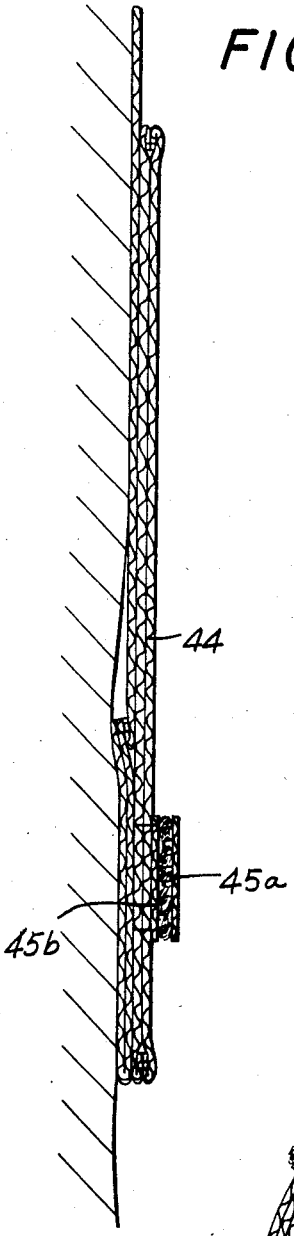
FIG. 12
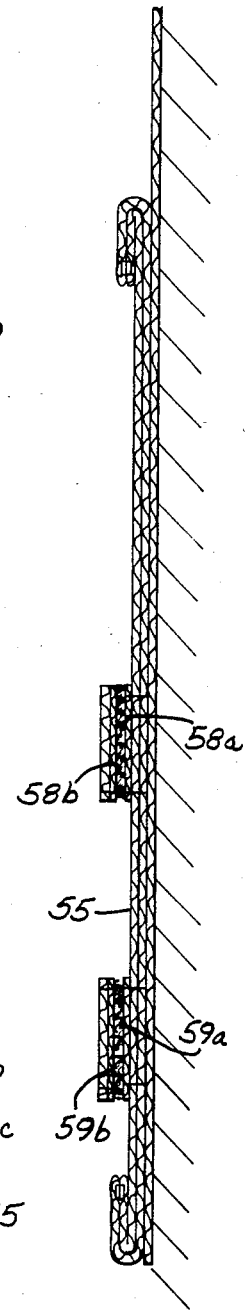
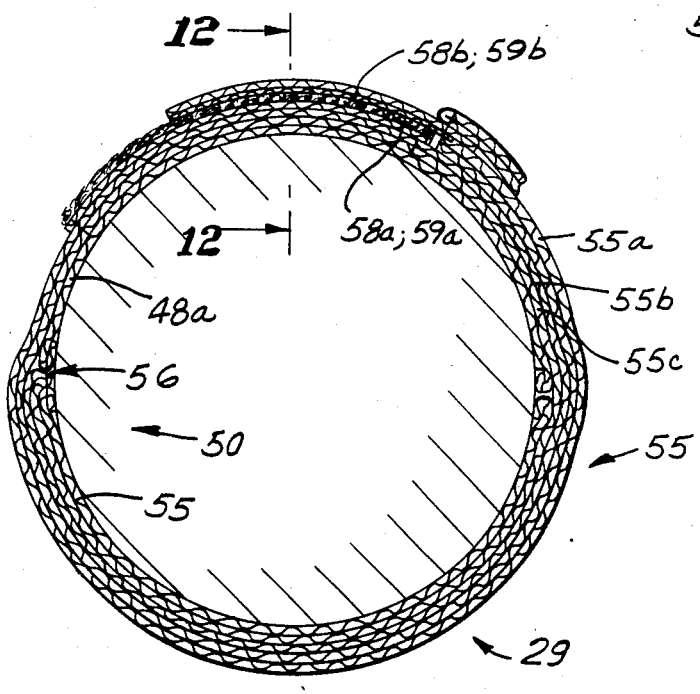
FIG. 11

FASHION/EXERCISE GARMENT

FIELD OF THE INVENTION

The invention pertains to a fashion/exercise garment, and more particularly to a fashion/exercise garment having built-in neck, arm and leg warmers.

BACKGROUND OF THE INVENTION

Dancers, gymnasts and acrobats almost all train in tight fitting fashion/exercise garments. Such garments are often made from stretchable fabrics to provide conformity to the body of the individual. The tight fit is essential to provide a streamlined feeling and appearance while the dancer or gymnast is performing.

Quite often, however, dancers must perform in cold environments, which necessitates the use of arm and leg warmers or wraps. Such warmers are bulky and generally unsightly. Often the dancers try to fit the garment over these bulky warming wraps, causing the garment to distort and stretch at the extremities beyond the resilient limits. The garment will then develop unsightly bulging, and will tend to wear faster in these areas, as well as produce air-leakage.

Where the wraps and warmers are applied over the garment, they are often held in place by crude means, such as rubber bands. Often, while performing, these warmers will tend to slip or slide over the ankle or wrist. These dislocations are a source of bother and concern to the dancer, requiring frequent adjustments in some cases.

The present invention features a fashion/exercise garment wherein the warmers are built-in to the garment, such that the above disadvantages are essentially reduced or eliminated.

One of the advantages realized from the invention, is the fact that the built-in warmers are shaped to conform to the extremities. In this fashion, the garment is designed to maintain a sleek, streamlined appearance despite the overlay of materials.

The built-in warmers of the invention will remain in place despite strenuous exercises and movements.

Another advantage of having a garment with built-in warmers is the convenience of dressing oneself with apparel that has all the features at the users command. One need not fumble in a duffle bag for warmers or other garment paraphernalia; everything needed is built-in to the garment.

BRIEF SUMMARY OF THE INVENTION

The invention features a fashion/exercise garment having many uses. For example, it may be used by individuals such as dancers, gymnasts and acrobats as part of their warm-up routine or in conjunction with their actual performance. In addition, it may be used by fashion-conscious individuals as part of their wearing apparel. The garment has built-in warming wraps disposed at the extremity portions of the garment, i.e., at the neck, wrists and ankle sections of the garment. The wraps comprise elongated strips or bindings which extend from these extremity portions and which affixedly wind about these extremity portions to provide a raised wrap.

The garment generally has two body sections, an upper body section and a lower body section. The upper body section has the form of a jersey having sleeves and openings at the wrist and neck extremity portions. The lower body section has the form of tights having legs and openings about the ankle extremity portions. The wrist and ankle portions have adjustment means to tighten and conform the extremity portions about the individual to provide good fit and a sleek appearance. The adjustment means comprises an overlapping piece of material that extends along a slit in each wrist and ankle portion. The slit allows easy entry and insertion of a respective hand or foot into the wrist and ankle portions of the garment, and the overlapping piece securely wraps these wrist and ankle portions about the individual for a tight conforming fit.

Both the bindings and the overlapping material have an adhering strip to affix the position of the wrap. The adhering strip can be a material such as Velcro®.

The bindings extend for substantially an equal distance along the extremity portions of the garment as do the slits. The bindings about the wrists and ankle portions have a decreasing taper outwardly extending from the point of attachment. The neck warmer, however, has a binding which decreasingly tapers from a mid-portion thereof.

BRIEF DESCRIPTION OF THE DRAWINGS

FIG. 10 is a sectional view taken along lines 10—10 of FIG. 9;

FIG. 11 is a sectional view of the garment taken along lines 11—11 of FIG. 1; and FIG. 12 is a sectional view taken along lines 12—12 of FIG. 11.

DETAILED DESCRIPTION OF THE INVENTION

Generally speaking the invention relates to a fashion/exercise garment having built-in warmers in the form of wrap around bindings attached to, and extending from the extremity portions of the garment.

Figure 1:
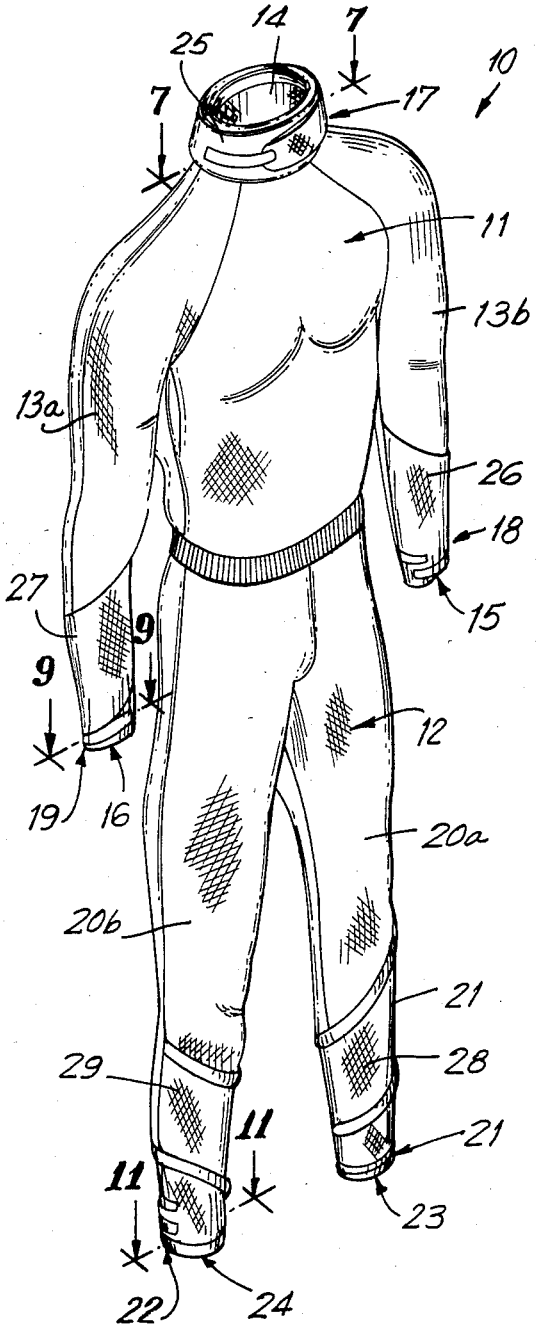
FIG. 1 is a frontal perspective view of the garment of this invention.
Figure 2:
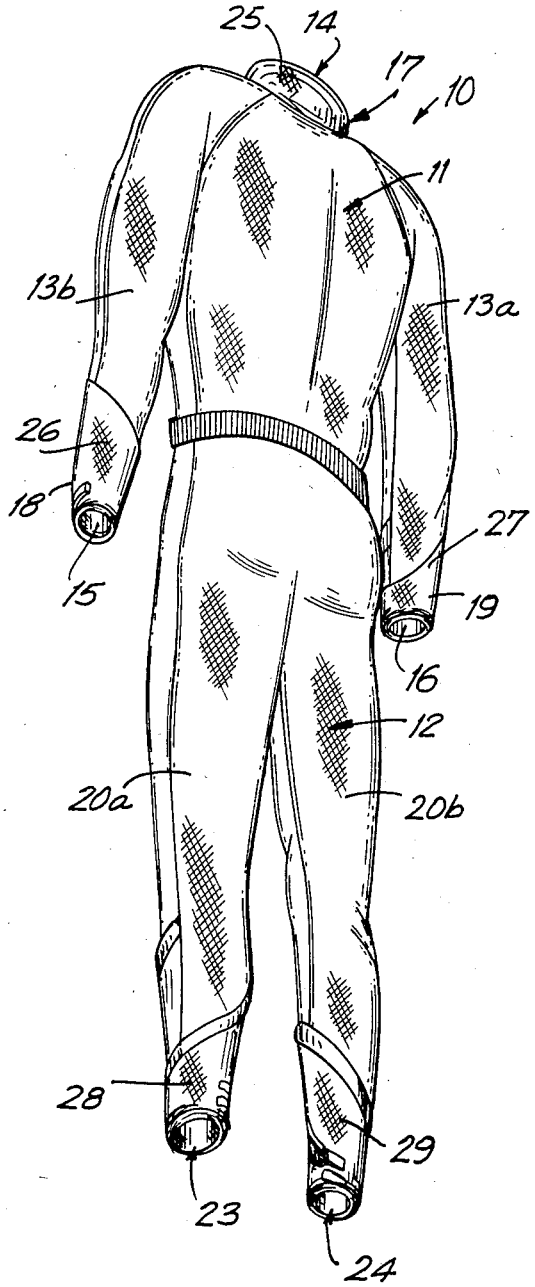
FIG. 2 is a back view of the garment shown in FIG. 1.

Referring now to FIGS. 1 and 2, the garment-10 is shown in front and back views having an upper section or jersey 11 and a lower section or tights 12. For purposes of brevity, like elements will have the same designations throughout the description.

The jersey 11 comprises a pair of sleeves **13*a* and 13*b*, respectively, and neck and wrist openings 14, 15 and 16, respectively about the neck 17 and wrists 18 and 19**, respectively.

The pair of tights 12 comprise two legs 202 and 206, respectively, having ankle openings 23 and 24, respectively, about ankles 21 and 22.

Built-in warmers 25, 26, 27, 28, and 29 are respectively shown wrapped about the neck 17, the wrists 18 and 19, and the ankles 21 and 22. It can be seen that the warmers 25, 26, 27, 28 and 29 are neatly and conformingly wrapped about the garment 10 such that the garment maintains its sleek and streamlined appearance. The warmers 25, 26, 27, 28 and 29 are each integrally attached at extremity portions to the garment 10, as will be explained in more detail hereinafter, with reference to FIGS. 3 through 6.

Figure 3:
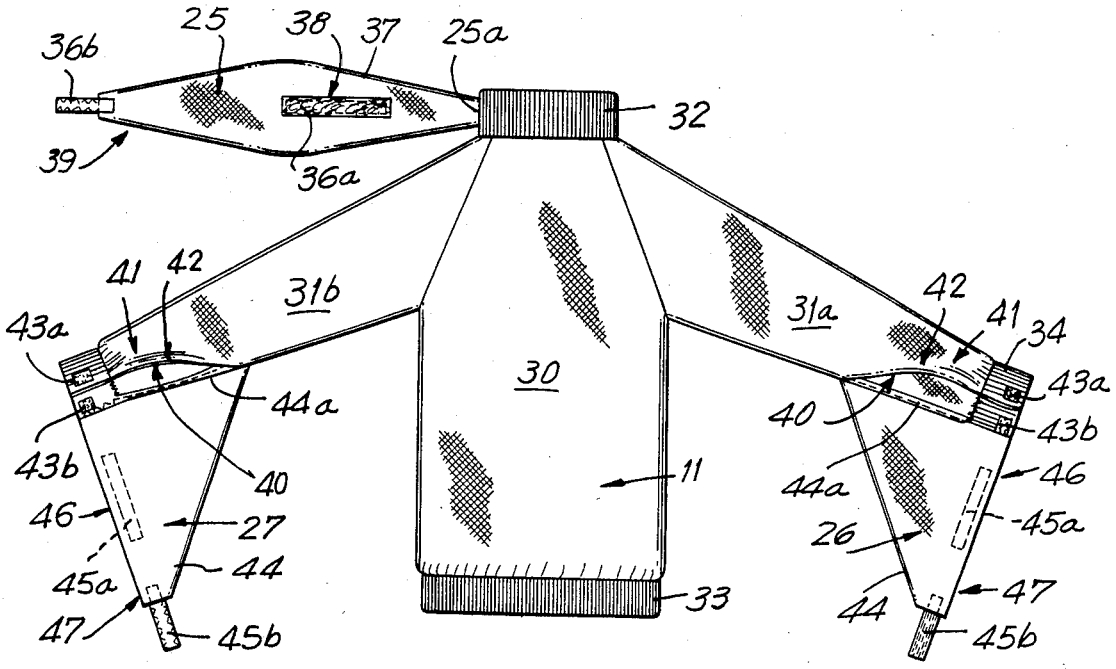
FIG. 3 is a front view of the upper body section of the garment depicted in FIG. 1.
Figure 4:
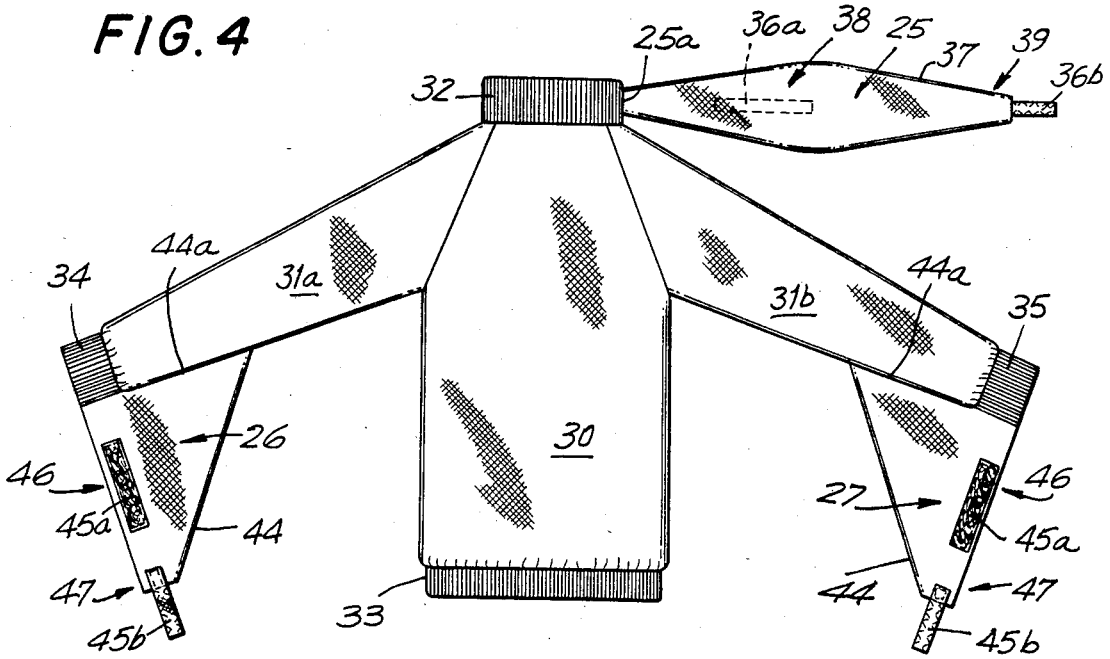
FIG. 4 is a back view of the upper body section illustrated in FIG. 3.

Referring to FIGS. 3 and 4, the jersey 11 or upper body section of the garment 10 is shown in more detail. FIG. 3 is a front view of the jersey 11, and FIG. 4 is a back view thereof. The warmers 25, 26 and 27 are depicted in their unwrapped or extended state. The jersey 11 comprises a main body 30 having two sleeves 31*a* and 31*b* for left and right arms, respectively. The body 30 of jersey 11 has a turtle-neck extension 32 at the top thereof, and a waist-band extension 33 at the bottom. These extensions 32 and 33 may each be made from elasticized fabric to provide a more secure fit about the neck and waist if desired, and/or may be made of thicker material to provide bulk at the borders of body 30. Cuff extensions 34 and 35 are provided on the sleeves 31*a* and 31*b*, respectively, and are made of similar construction as extensions 32 and 33.

A warmer 25 comprising a soft material diamond-shaped binding 37 is attached at seam 25*a* by appropriate stitching to neck extension 32, and is illustrated in its extended state. The warmer 25 has matching strips 36*a* and 36*b* of Velcro ® disposed at the mid-portion 38 and end portion 39, as shown. These matching adhering strips 36*a* and 36*b* bind to each other, and secure the binding 37 in its wound state, as illustrated in FIGS. 1 and 2.

The sleeves 31*a* and 31*b* each have slits 40 at cuff ends 41, as illustrated. The slits 40 allow easy access and insertion of the hands of the dancer into the cuff extensions 34 and 35. Cuff ends 41 include overlapping sleeve material 42 about slits 40, in order to provide complete material coverage about the wrists of the dancer. The overlapping material 42 may be pulled tightly over the wrist and secured by matching Velcro ® tabs 43*a* and 43*b*.

The wrist warmers 26 and 27 are attached to respective sleeves 31*a* and 31*b*, as depicted. The warmers 26 and 27 comprise decreasingly tapered soft material bindings 44 that are integrally attached to the respective sleeves by appropriate stitching at respective seams 44*a*. The bindings 44 are illustrated in FIGS. 3 and 4 in their extended state, and in their wrapped or wound state in FIGS. 1 and 2. Matching Velcro ® strips 45*a* and 45*b* which are disposed at mid-portion 46 and end portion 47 of bindings 44 are utilized to secure the bindings 44 in their wound state. The bindings 44 generally are attached at seam 44*a* for a distance substantially equal to the length of slits 40, and assist the overlapping material 42 in sealing the slits 40 against air leakage.

Figure 5:
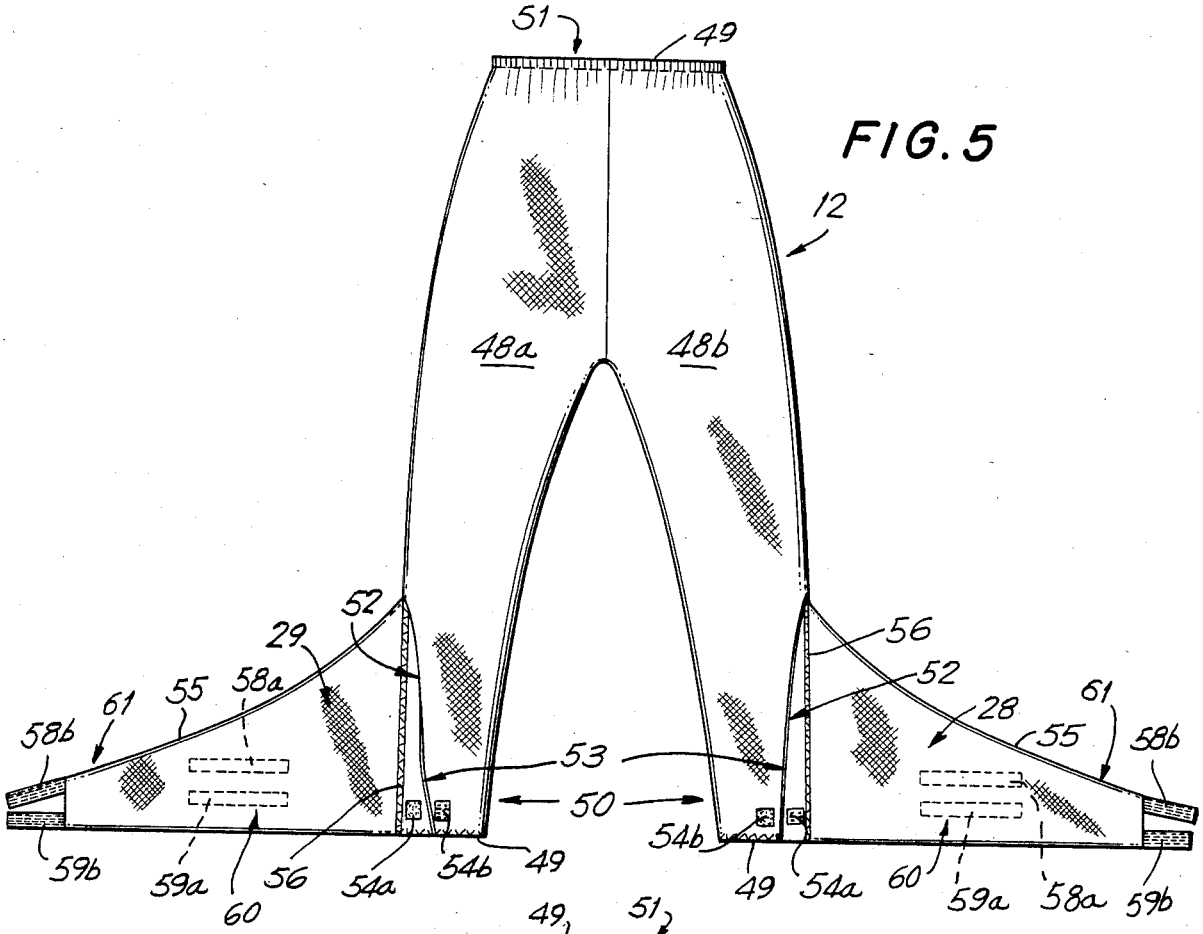
FIG. 5 is a front view of the lower body section of the garment shown in FIG. 1.
Figure 6:
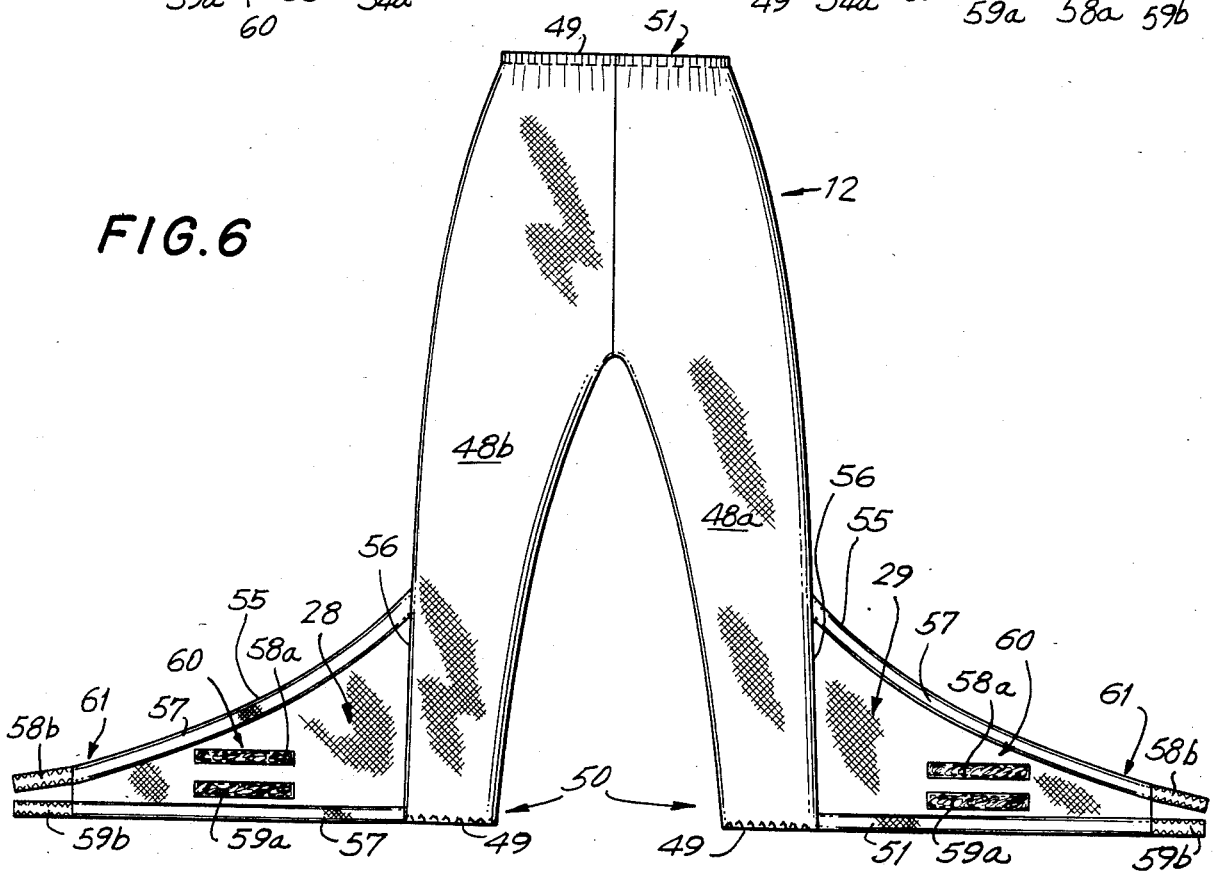
FIG. 6 is a back view of the lower body section depicted in FIG. 5.

Referring to FIGS. 5 and 6, front and rear views of the tights 12 of the garment 10 are illustrated in more detail. The tights 12 comprise a right and left leg section 48*a* and 48*b*, respectively. The tights 12 have finishing borders 49 at the waist 51 and at the cuff end portion 50 of legs 48*a* and 48*b*.

The cuff end portion 50 of leg sections 48*a* and 48*b* has an access slit 52, similar to the slits 40 provided on the cuff ends 41 of sleeves 31*a* and 31*b* of jersey 11, shown in FIG. 3.

The leg slits 52 serve the purpose of providing easy access and insertion of a foot into the respective leg section 48*a* and 48*b*. Overlapping material 53 is similarly provided about slits 52 to provide warmth and reduce air leakage. The cuff ends 50 are tightly secured by matching Velcro ® tabs 54*a* and 54*b*.

The leg warmers 28 and 29, respectively comprise soft material bindings 55 which are integrally attached to respective end portions 50 of leg sections 48*a* and 48*b*, by appropriate stitching at seams 56. The leg bindings 55 shown extended in FIGS. 5 and 6 have reinforced edges 57 extending along the decreasingly tapered length thereof. The reinforced edges assist the bindings 55 in maintaining their wound state shown in FIGS. 1 and 2, i.e. edges 57 prevent the warmers 28 and 29 from unwinding during strenuous movements and exercises.

A pair of matching Velcro ® strips 58*a*; 58*b* and 59*a*; 59*b* are provided at the mid portion 60 and at the end portion 61 of the bindings 55, respectively. The pair of Velcro ® strips 58*a*; 58*b* and 59*a*; 59*b* secure the leg bindings 55 in their wound position.

The jersey 11 and the tights 12 can be fabricated of standard garment materials, as can the soft material warmers 25, 26, 27, 28 and 29. The warmers can be attached to the jersey 11 and tights 12 by integral stitching or in an alternate embodiment may be attached by metal snaps (not shown) so as to be removable from the garment on warm days, when not required, or when washing is required.

FIGS. 7 through 12 depict sectional views taken through the various warmers 25; 26 and 27; and 28 and 29; respectively.

Figure 7:
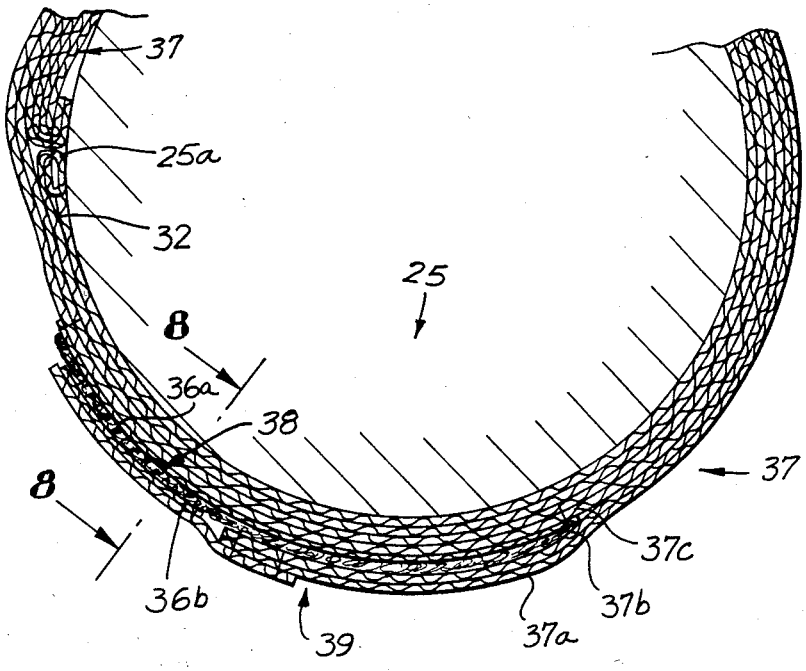
FIG. 7 is a sectional view of the garment taken along lines of 7—7 of FIG. 1.
Figure 8:
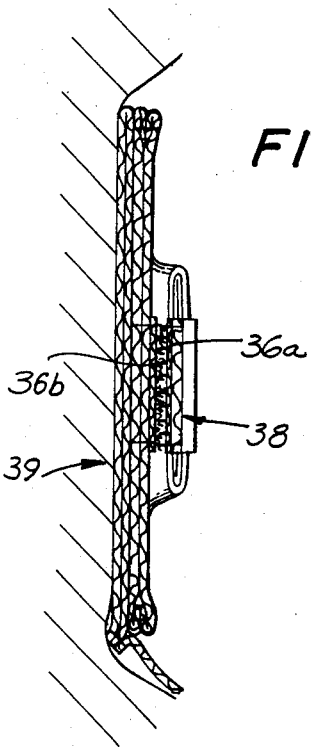
FIG. 8 is a sectional view taken along lines 8—8 of FIG. 7.

FIGS. 7 and 8 illustrate the neck warmer 25, with the soft material binder 37 wound in layers 37*a*, 37*b*, 37*c*, etc. The end portion 39 shows the Velcro ® strip 36*b* attached to strip 36*a* at mid portion 38, so as to hold the layers 37*a*, 37*b*, 37*c*, etc. in their wound state.

Figure 9:
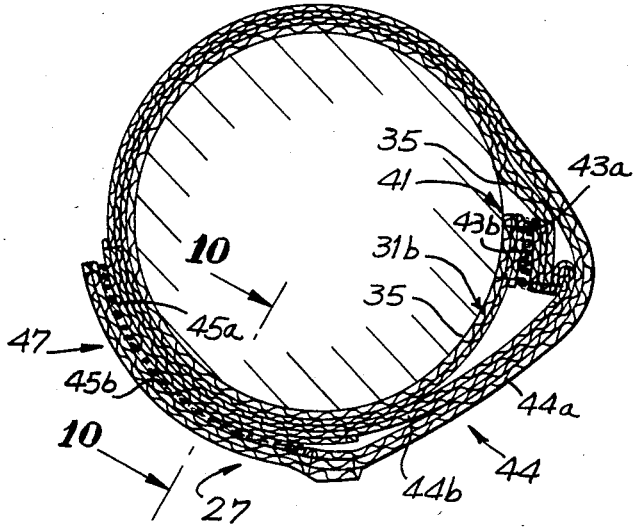
FIG. 9 is a sectional view of the garment taken along lines 9—9 of FIG. 1.

The wrist warmer 27 (also applies to warmer 26) is shown in sectional view in FIGS. 9 and 10. The binding 44 is shown wrapped in layers 44*a*, 44*b*, etc. about the end portion 41 and cuff end 35 of sleeve 31*b*. The Velcro ® tabs 43*a* and 43*b* secure the cuff end 35 and the Velcro ® strips 45*a* and 45*b* secure the binding 44 in its wound condition.

The leg warmer 29 (also applies to warmer 28) is shown in sectional view in FIGS. 11 and 12. The binding 55 is shown in wound layers 55*a*, 55*b*, etc. The Velcro ® strips 58*a*; 58*b* and 59*a*; 59*b* hold the binding 55 in its wound condition.

Having thus described this invention what is desired to be protected by Letters Patent is presented in the following appended claims:

1. A two-piece garment to be worn indoors for exercising and dancing, comprising an upper body section and a lower body section, said upper body section having the form of a jersey having sleeves and openings about neck and wrist extremity portions, said lower body section having the form of a pair of tights having legs and openings about ankle extremity portions, and a warmer disposed adjacent one of said extremity portions, said warmer having the form of an elongated tapered binding that extends from, and winds more than once about, the said extremity portion to provide a raised wrap while said taper provides a tight, conforming, streamlined profile to said extremity.

2. The garment of claim 1, wherein said warmer for said extremity portion comprises a neck binding that decreasingly tapers from a mid-portion thereof.

3. The garment of claim 1, wherein said warmer for said extremity portion comprises a wrist binding that decreasingly tapers outwardly from said extremity portion.

4. The garment of claim 1, wherein each warmer for said extremity portion comprises an ankle binding that decreasingly tapers outwardly from said extremity portion.

5. A two-piece garment to be worn indoors for exercising and dancing, comprising an upper body section and a lower body section, said upper body section having the form of a jersey having sleeves and openings about neck and wrist extremity portions, said lower body section having the form of a pair of tights having legs and openings about ankle extremity portions, and a plurality of warmers disposed adjacent each extremity portion, each warmer having the form of an elongated tapered binding that extends from, and winds more than once about, its respective extremity portion to provide a raised wrap while said taper provides a tight, conforming, streamlined profile to said extremity.

6. The garment of claim 5, wherein said warmer for said neck extremity portion comprises a binding that decreasingly tapers from a mid-portion thereof.

7. The garment of claim 5, wherein said warmers for said wrist and ankle extremity portions comprise a binding that decreasingly tapers outwardly from said extremity portion.

8. The garment of claim 5, wherein each binding includes means for fastening said binding in a wound position about its respective extremity portions.

9. The garment of claim 8, wherein said fastening means comprises an adhering strip disposed upon said binding.

10. The garment of claim 5, wherein said wrist and ankle extremity portions of said garment each comprise adjustment means for conforming said respective extremity portions to the individual extremities of the wearer of said garment.

11. The garment of claim 10, wherein said adjustment means includes a slit in said wrist and ankle extremity portions for allowing easy insertion of a respective hand and foot into said respective extremity portions of said garment.

12. A garment of claim 11, wherein each of said slits extends along a respective sleeve and leg for a distance substantially equal to a length of attachment of a respective binding.

13. The garment of claim 11, wherein each of said adjustment means comprises an overlapping piece of material disposed about said slit.

14. The garment of claim 11, wherein each of said adjustment means includes a securing means for fixing said respective adjustment means to a desired conforming position.

15. The garment of claim 14, wherein each of said securing means comprises an adhering strip disposed upon the respective extremity portion of said garment.

* * * * *